United States Patent [19]

Blazek

[11] Patent Number: 4,850,419

[45] Date of Patent: Jul. 25, 1989

[54] METHOD OF CASTING A ONE-PIECE WHEEL

[75] Inventor: William S. Blazek, Valley City, Ohio

[73] Assignee: TRW Inc., Lyndhurst, Ohio

[21] Appl. No.: 413,835

[22] Filed: Sep. 1, 1982

[51] Int. Cl.[4] ..... B22D 27/04

[52] U.S. Cl. ..... 164/122.1; 114/122.2

[58] Field of Search ..... 164/122.1, 122.2

[56] References Cited

U.S. PATENT DOCUMENTS

| | | | |
|---|---|---|---|
| 1,015,362 | 1/1912 | Vial . | |
| 3,283,377 | 11/1966 | Chandley . | |
| 3,312,449 | 4/1967 | Chandley . | |
| 3,417,809 | 12/1968 | Sink . | |
| 3,538,981 | 11/1970 | Phipps | 164/122.1 X |
| 3,598,169 | 8/1971 | Copley et al. | 164/122.1 |
| 3,680,625 | 8/1972 | Hein et al. | 164/122.1 X |
| 3,754,592 | 8/1973 | Müllen | 164/122.1 |
| 4,152,816 | 5/1979 | Ewing et al. . | |
| 4,240,495 | 12/1980 | Vonnegut | 164/122.2 X |

FOREIGN PATENT DOCUMENTS

| | | |
|---|---|---|
| 2319445 | 2/1977 | France . |

*Primary Examiner*—Kurt Rowan

*Attorney, Agent, or Firm*—Tarolli, Sundheim & Covell

[57] ABSTRACT

An improved method is provided to cast a one-piece wheel having a circular hub and a plurality of airfoils. The method includes providing a mold having a circular main section and a plurality of open-ended airfoil forming sections. Each of the airfoil forming sections has a thick leading edge portion and a thin trailing edge portion. During a casting operation, the mold is preheated while it is spaced from a chill. The mold and chill are then moved into abutting engagement with the chill extending across the open outer end portion of the airfoil forming sections. The relatively thick leading edge portions of the airfoil forming sections are disposed adjacent to a portion of the chill. Molten metal is poured into the mold cavity and flows outwardly through the airfoil forming sections into engagement with the chill. This results in solidification of columnar grains of metal in a direction toward the center of the mold cavity. As the molten metal is solidifying, heat is conducted at a greater rate from the relatively thick leading edge portions of the airfoils than from the relatively thin trailing edge portions of the airfoils. Therefore, the columnar grains grow in a direction parallel to the central axes of the airfoils.

64 Claims, 3 Drawing Sheets

METHOD OF CASTING A ONE-PIECE WHEEL

BACKGROUND AND SUMMARY OF THE INVENTION

The present invention relates to a new and improved method of casting an article and more specifically to the method of casting a one-piece wheel having a hub portion and a plurality of airfoils which project outwardly from the hub portion.

One-piece metal wheels having a circular hub portion with radially outwardly projecting airfoils have previously been used in turbine engines. The airfoils on these wheels have previously been made with an equiaxed crystalline structure. Due to the severe operating conditions under which the one-piece wheels are used, it has been suggested that the wheels be formed with airfoils having an elongated columnar grain structure similar to that shown in U.S. Pat. Nos. 3,417,809 and 3,485,291.

In an effort to cast a one-piece wheel having airfoils with a columnar grain crystalline structure, it has been suggested that a mold be formed in the manner shown in U.S. Pat. No. 4,240,495. This mold is provided with a main section in which a circular wheel disc is cast and a plurality of radially outwardly projecting airfoil forming sections. Each airfoil forming section has an open inner end which is connected in fluid communication with the portion of the mold cavity in which the wheel disc is formed. The airfoil forming sections are closed at their outer ends where the tips of the airfoils are formed.

The aforementioned Patent No. 4,240,495 indicates that the desired columnar grain crystalline structure can be obtained by providing a chill formed of steel shot adjacent to the closed ends of the airfoil forming sections. This steel shot is described in the patent as providing a sufficient mass of thermally conductive material to withdraw heat from the airfoils and to promote the growth of columnar grains. According to the patent, the growth of the columnar grains is also promoted by the provision of cavities which are disposed adjacent to the airfoil forming portions. These cavities hold molten metal and are intended to prevent the airfoil forming portions from cooling too rapidly.

Since the mold and the shot chill shown in U.S. Pat. No. 4,240,495, are disposed in a container which is heated during preheating of the mold, the effectiveness of the chill is diminished. This impedes the formation of airfoils having a columnar grain structure with longitudinal axes of the grains extending parallel to the central axes of the airfoils. The formation of columnar grains which extend parallel to the central axes of the airfoils is further impeded by the necessity of solidifying the relatively thick leading edge portions and relatively thin trailing edge portions of the airfoils along fronts which extend perpendicular to the central axes of the airfoils.

SUMMARY OF THE PRESENT INVENTION

The present invention provides a new and improved method of forming a cast one-piece wheel having a plurality of airfoils with a desired crystalline structure. The wheel is cast in a mold having open ended airfoil forming sections. Thus, each of the airfoil forming sections has an inner end which opens into a central portion of the mold and an outer end at an opening in an outer side surface area of the mold.

After the mold has been preheated, the mold and chill are brought into engagement. The chill has a surface which blocks the open outer ends of the airfoil forming sections. When molten metal is poured into the mold, it flows through the airfoil forming sections into engagement with the chill at the open outer ends of the airfoil forming sections. Assuming that it is desired to form the airfoils with a columnar grain crystalline structure, the rapid removal of heat from the molten metal by the chill promotes the growth of columnar grains inwardly away from the chill, through the airfoil forming sections, to the central portion of the mold.

Heat is transferred from the relatively thick leading edge portions of the airfoil forming sections to the chill at a greater rate than from the relatively thin trailing edge portion of the airfoil forming sections. This promotes solidification of the molten metal in the airfoil forming sections along fronts which extend generally perpendicular to the longitudinal central axes of the airfoils. When a columnar grain crystalline structure is desired, this promotes the growth of columnar crystals having longitudinal axes which extend parallel to the central axes of the airfoils.

Accordingly, it is an object of this invention to provide a new and improved method of casting a one-piece wheel by flowing molten metal through open-ended airfoil forming sections into engagement with a chill and initiating solidification of the molten metal in the airfoil forming forming sections at the chill.

Another object of this invention is to provide a new and improved method of casting a one-piece wheel having a hub portion and a plurality of airfoils with thick leading edge portions and thin trailing edge portions and wherein heat is transferred at a greater rate from the portions of the mold in which the leading edge portions of the airfoils are formed than from the portions of the mold in which the trailing edge portions of the airfoils are formed.

Another object of this invention is to provide a method of casting an article wherein a mold is preheated while it is spaced from a chill, the preheated mold and chill are moved into engagement with the chill extending across an opening which is connected in fluid communication with a mold cavity.

Another object of this invention is to provide a new and improved method of casting a one-piece wheel with a plurality of airfoils having a columnar grain crystalline structure with longitudinal axes of the columnar grains extending generally parallel to the longitudinal central axes of the airfoils, and wherein the method includes the steps of preheating a mold while it is spaced from a chill, moving the preheated mold and chill into abutting engagement, engaging the chill with molten metal at open outer end portions of airfoil forming sections of the mold, and solidifying the molten metal by growing a plurality of grains of metal inwardly away from the chill through the airfoil forming sections.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

One-Piece Wheel

Figure 1:
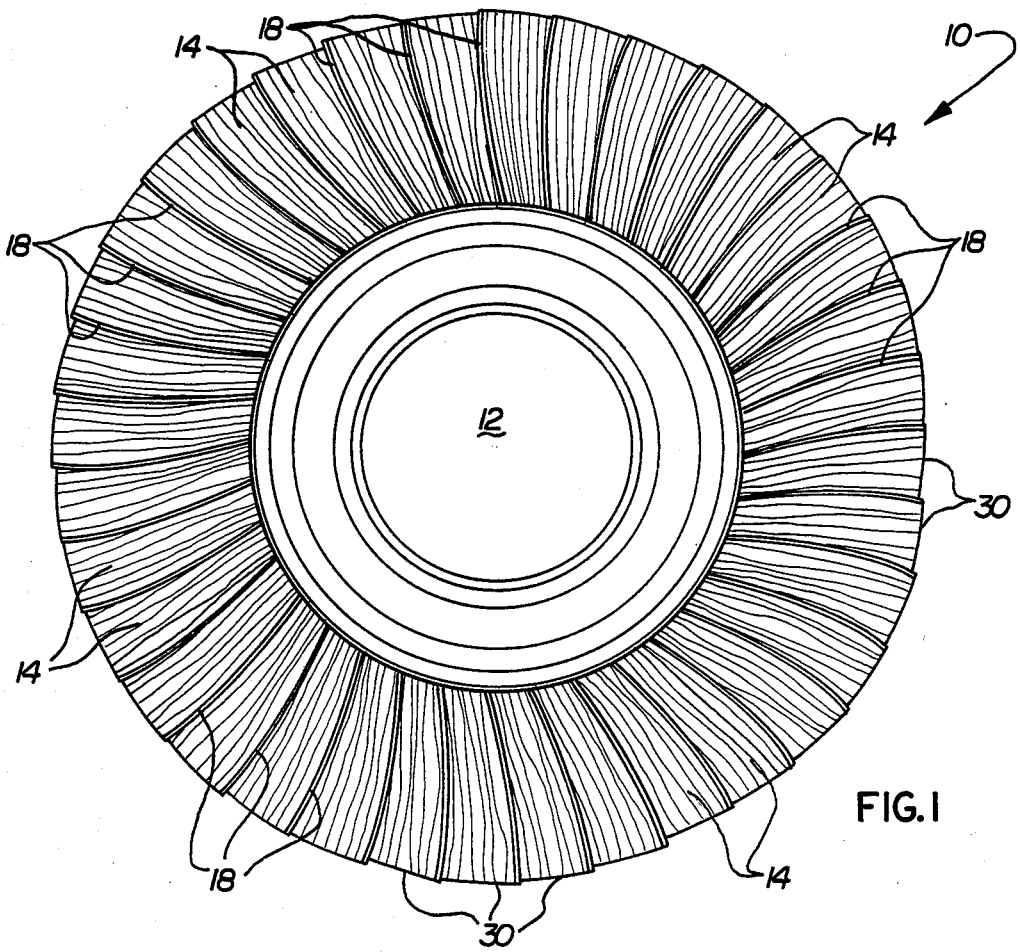
FIG. 1 is a plan view of a one-piece wheel having a circular hub portion with a plurality of radially outwardly projecting airfoils having a columnar grain crystalline structure.

A one-piece wheel 10 for use in a jet engine is illustrated in FIG. 1. The one-piece wheel 10 has a circular hub portion 12 and a plurality of radially outwardly projecting airfoils 14 disposed in a circular array about the periphery of the hub. Each of the airfoils 14 has a columnar grain crystalline structure with the longitudinal axes of the columnar grains extending generally parallel to the longitudinal central axes of the airfoils. The majority of the hub 12 has an equiaxed grain structure. Although the airfoils 14 are advantageously formed with a columnar grain crystalline structure, other known crystalline structures could be. used if desired.

Figure 2:
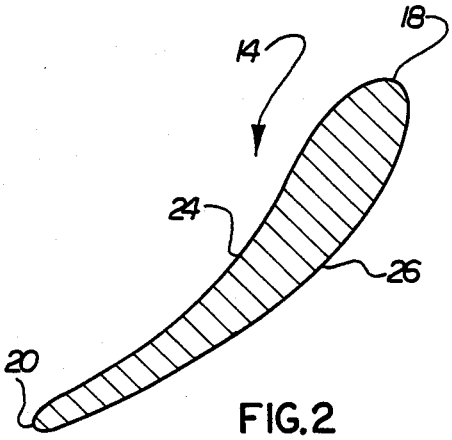
FIG. 2 is a sectional view through one of the airfoils of the wheel of FIG. 1 and illustrating the relatively thick construction of the leading edge portion of the airfoil and the relatively thin construction of the trailing/edge portion of the airfoil.

Each of the airfoils 14 has a relatively thick leading edge portion 18 and a relatively this trailing edge portion 20 (see FIG. 2). The leading portions 18 and 20 are interconnected surfaces 24 and 26 of the airfoil 14 Since the overall configuration of the airfoil 14 is will known, it will not be further described herein in order to avoid prolixity of description.

Figure 3:
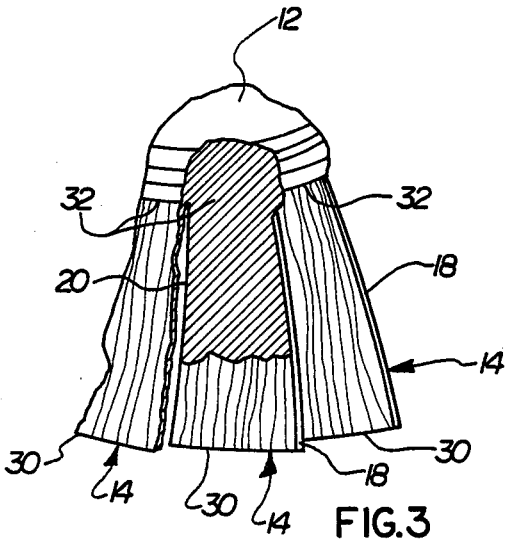
FIG. 3 is a fragmentary sectional view of a portion of the wheel of FIG. 1 and illustrating the columnar grain crystalline structure of the airfoil and the manner in which the airfoils are cast as one-piece with a hub portion of the wheel.

Each of the metal airfoils 14 has a columnar grain crystalline structure which has been indicated schematically in FIGS. 1 and 3. The columnar grains extend from the radially outer tip end portions 30 of the airfoils inwardly to the root end portions 32 (FIG. 3). The columnar metal grains in each of the airfoils 14 have longitudinal central axes which extend generally parallel to the longitudinal central axes of the airfoils. Although it is preferred to form the airfoils 14 with a columnar grain structure in order to obtain the known advantages of this grain structure, other known crystalline structures could be provided if desired.

The columnar grains in the airfoils 14 extend radially inwardly past the root end portion 32 of each of the airfoils a short distance into the hub 12. However, the majority of the hub 12 is formed with an equiaxed grain structure. Since the wheel 10 is cast as one piece, there are no joints between the airfoils 14 and the hub 12. This results in the one-piece wheel having a relatively strong construction.

Mold Construction

Figure 4:
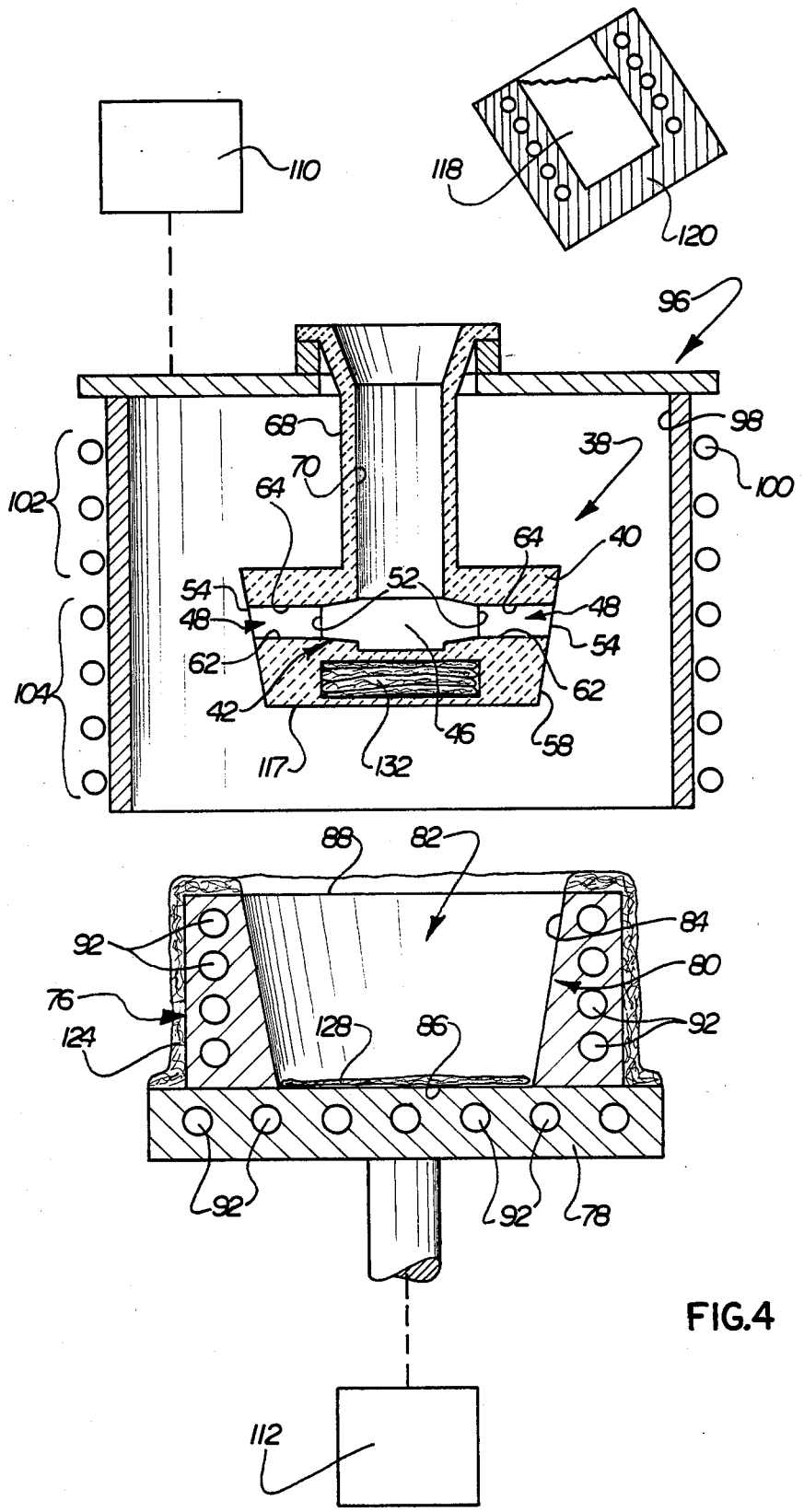
FIG. 4 is a schematic illustration of a mold and a chill, the fold being spaced from the chill while the mold is being preheated.

The one-piece wheel 10 is cast in a ceramic mold 38 (see FIG. 4). The mold 38 has a circular main section 40 in which a wheel mold cavity 42 is formed. The mold cavity 42 has the same configuration as the one-piece wheel 10 of FIG. 1. Thus, the mold cavity 42 (FIG. 4) has a circular main or hub forming section 46 with the same configuration as the circular hub 12 of the wheel 10. A plurality of airfoil forming sections 48 extend radially outwardly from the circular main section 46 of the mold cavity 42. The airfoil forming sections 48 have the same configuration as the airfoils 14 of the one-piece wheel 10. However, the airfoil forming sections 48 could have outer end portions with a configuration which is different than the configuration of the tip end portions 30 of the airfoils 14. If this was done, the metal cast in the outer end portions of the airfoil forming sections 48 would be removed from the airfoils.

The airfoil forming sections 48 have an open ended construction. Thus, a root end opening 52 is formed at a radially inner end portion of each of the airfoil forming sections 48 and a tip end opening 54 is formed at a radially outer end of the airfoil forming sections 48. The tip end openings 54 are disposed in a circular array in a circular outer side surface 58 of the main section 40 of the mold 38. The circular outer side surface 58 has the configuration of a frustrum of a cone.

The airfoil forming sections 48 have longitudinally extending leading edge forming portions 62 and trailing edge forming portions 64. The leading and trailing edge forming portions 62 and 64 of each of the airfoil forming sections 48 extend between the outer side surface 58 and hub forming section 46 of the mold cavity 42. Due to the configuration of the airfoils 14 (see FIG. 2), the leading edge forming portions 62 of the airfoil forming sections 48 are thicker or wider than the trailing edge forming portions 64 of the airfoil forming sections.

A generally cylindrical sprue 68 extends axially upwardly from the main portion 40 of the mold 38. The sprue 68 has a cylindrical central passage 70. The passage 70 is disposed in a coaxial relationship with the circular main section 46 and the circular array of airfoil forming sections 48.

The mold 38 is advantageously formed by covering a wax pattern with ceramic mold material and then removing the pattern and firing the mold material. Thus, a wheel pattern section having the same configuration as the wheel 10 is formed of either natural or artificial wax. It may be preferred to form the hub pattern of wax and each airfoil pattern of plastic. A columnar sprue pattern section having the same configuration as the interior passage in the sprue 70 is formed of wax and connected with the wheel pattern.

In order to form the outer side surface 58 of the main section 40 of the mold, a rim pattern section is formed of wax and connected with the outer end portions of the airfoils of the wheel pattern. This rim pattern section may advantageously have a relatively thin radial section and a configuration corresponding to the frustum of a cone. This results in the rim pattern section having an appearance similar to the appearance of a lamp shade. A central portion of the inner side surface of the rim pattern section is connected with the outer ends of the wax airfoils of the wheel pattern.

Once the rim, wheel and sprue pattern sections have been interconnected, they are covered with a ceramic mold material. The circular upper and lower ends of the rim section are wiped as each layer of ceramic mold material is applied over the pattern. This separates the ceramic mold material overlying the radially outer portion of the rim from the remainder of the mold.

Once the mold has been built up to a desired thickness, the wax pattern material is removed by heating or using a suitable chemical solvent. Removing the wax pattern material and the ceramic material overlying the outer side surface of the rim exposes the outer side surface 58 of the mold and the circular array of openings 54. Thus, the circular outer side surface 58 of the mold 38 is shaped by the inner side surface of the rim pattern. The tip end openings 54 are shaped by the outer ends of the wax airfoil patterns. The ceramic mold material is then fired to form the mold 38.

The materials from which the mold 38 is formed and the method by which it is made are generally similar to that disclosed in U.S. Pat. No. 4,066,116 and will not be further described herein. However, it should be understood that other mold materials and methods could be used to form the mold 38 if desired.

Chill Construction

A chill 76 is used in order to obtain the desired crystalline structure of the airfoils 14. The chill 76 has a circular base or end wall 78. An upwardly projecting annular side wall 80 is fixedly connected to the end wall 78. The end wall 78 and side wall 80 cooperate to define an open ended chill cavity 82. If desired, the end wall 78 could be omitted.

The chill cavity 82 has a side surface 84 with a configuration corresponding to the frustrum of a cone. The conical side surface 84 extends from a flat circular side surface 86 of the end wall 78 of the chill to a circular opening 88 at the axially outer or upper end of the side wall 80. The inner side wall 84 of the chill cavity 82 has the same slope or taper as the outer side surface 58 of the main section 40 in the mold 38. Although it is contemplated that the side surface 84 of the annular chill wall 80 and the side surface 58 of the mold 38 could taper at any desired angle between 5 and 20 degrees, it is preferred to use a taper of approximately 10 degrees. It should be noted that the chill cavity 82 has an axial extent which is greater than the axial extent of the main section 40 of the mold 38.

In order to provide for the conduction of heat from the chill 76 during a casting operation, passages 92 are formed in both the end wall 78 and annular side wall 80 to conduct cooling fluid. Thus, the walls 78 and 80 and are formed of copper or brass. The passages 92 formed in the end side walls 78 and 80 of the chill to conduct a flow of a cooling liquid during casting of the one-piece wheel 10. This cooling liquid will carry heat away from the chill 76 and prevent it from being damaged or destroyed by the molten metal from which the wheel 10 is formed.

Casting Operation

When a casting operation is to be undertaken, the mold 38 is preheated while it is spaced from the chill 76. Thus, during preheating, the mold 38 is disposed a substantial distance above the chill 76 in a high frequency induction furnace 96. The induction furnace 96 has a cylindrical graphite susceptor 98 which is circumscribed by turns of an induction coil 100. The induction coil 100 is formed in two separately energizable sections, that is an upper section 102 and a lower section 104. The mold 38 is preheated to a temperature which is above the melting point of the temperature of the metal to be poured.

Figure 5:
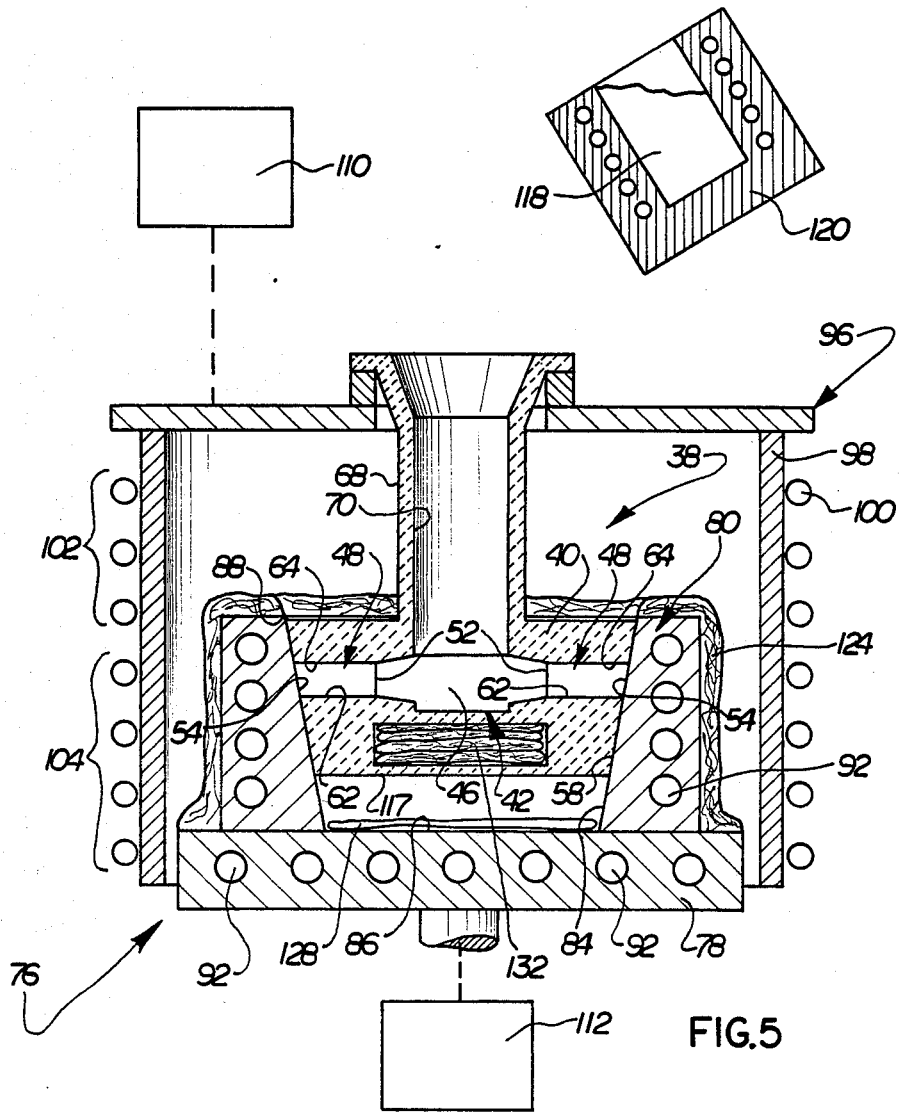
FIG. 5 is a schematic illustration, generally similar to FIG. 4, illustrating the preheated mold engaging the chill with open ended airfoil forming sections of the mold blocked by an annular surface of the chill.

Once the mold 38 has been preheated, the mold 38 and chill 76 are moved from the spaced apart relationship shown in FIG. 4 to the engaged relationship shown in FIG. 5. A drive assembly 110 is activated to move the mold 38 and furnace 96 downwardly toward the chill 76. At the same time, a second drive assembly 112 is activated to raise the chill 76 upwardly toward the mold 38. Although a pair of drive assemblies 110 and 112 have been illustrated in FIGS. 4 and 5 to move both the mold 38 and chill 76, it is contemplated that one of the drive assemblies could be omitted if desired. For example, the drive assembly 110 could be omitted and only the drive assembly 112 used to raise and lower the chill 76 relative to the stationary furnace 96 and mold 38.

As the mold 38 and chill 76 are moved together, the main section 40 of the mold moves through the circular opening 88 at the upper end of the annular chill section 80 and enters the chill cavity 82 (see FIG. 4). Continued movement between the mold 38 and chill 76 brings the conical outer side surface 58 on the mold into abutting engagement with the conical inner side surface 84 on the chill section 80 (see FIG. 5). The mold surface 58 is then disposed in tight abutting engagement with the chill surface 84. A circular lower surface 117 of the mold 38 is spaced from the end wall 78 of the chill when the mold surface 58 is disposed in tight abutting engagement with the chill surface 84.

The chill surface 84 extends across each of the openings 54 at the ends of the airfoil forming sections 48. Thus, the open radially outer ends of the airfoil forming sections 48 are blocked by the annular chill 80 when the mold 38 and chill 76 have been brought into abutting engagement in the manner shown in FIG. 5. At this time, the chill surface 84 tightly seals the open outer end portions of the airfoil forming sections 48.

Molten metal 118 is then poured from a melting furnace 120 into the mold 38. Although the molten metal 118 may have many different compositions, it is advantageously a nickel-chrome superalloy having a composition similar to that disclosed in U.S. Pat. No. 3,260,505. Of course, metals having other known compositions could be used if desired.

The molten metal is poured from the melting furnace 120 into the sprue 68. The molten metal flows axially downwardly through the sprue 68 into the main section 46 of the mold cavity 42. The molten metal then flows radially outwardly through the airfoil forming sections 48 to the side surface 84 of the annular chill 80.

The mold 38 is maintained in tight abutting engagement with the annular chill 80 to prevent leakage of metal between the outer side surface 58 of the mold and the inner side surface 84 of the chill. If the angle at which the conical side surfaces 58 and 84 of the mold 38 and chill 76 are tapered at too large an angle from the vertical, hydrostatic pressure forces will tend to separate the mold and chill. Therefore, it is preferred to have the outer side surfaces 58 and 84 of the mold 38 and chill 76 tapered at an angle of approximately 10 degrees to the vertical.

The molten metal flows to the openings 54 at the ends of the airfoil forming sections 48 and into engagement with the chill surface 84. Initial solidification of the molten metal at the chill surface 84 causes a plurality of grains initially solidify in a growth zone close to the chill. The more favorably oriented grains quickly crowd out the less favorably oriented grains and grow away from the chill in a radially inward direction toward the center of the mold cavity 42. If desired, the molten metal which solidifies against the chill surface 84 may subsequently be removed from the airfoils.

The solidified airfoils have an elongated columnar grain crystalline structure which is the same general crystalline structure as is described in U.S. Pat. Nos. 3,417,809 and 3,485,291. However, the chill 76 could be used to initiate the formation of other known crystalline structures, such as the crystalline structures described in U.S. Pat. Nos. 3,494,709; 3,542,120; and 4,133,368. Regardless of the crystalline structure, it may be desirable to remove the initial growth zone formed at the outer ends of the airfoil forming sections 48.

The growth of elongated columnar grains in a direction generally parallel to the longitudinal central axes of the airfoil forming sections 48 is promoted by the strong cooling effect of the annular chill 80. This cooling effect is promoted by conducting a flow of cold liquid through the passages 92 formed in the annular mold section 80 and end wall 78 of the chill. In addition, the effectiveness of the chill is promoted by providing a layer 124 of insulation around the outside of the annular chill 80.

After the molten metal in the airfoil forming sections 48 has solidified, the molten metal in the main section 46 of the mold cavity 42 begins to solidify. During this time, the metal in the sprue 68 remains molten to prevent the formation of shrink cavities in the main section 46 of the mold cavity 42. To this end, the lower cooling coils 104 may be shut off while the upper cooling coils 102 are maintained energized during the initial cooling of the molten metal in the airfoil forming sections 48. As the molten metal in the main section 46 solidifies radially inwardly toward the center of the mold cavity 42, the current in the upper section 102 to the induction coil is reduced to promote a gradual solidification of the molten metal in the upper portion of the main section 46 of the mold cavity, and, subsequently, the sprue passage 70.

Figure 6:
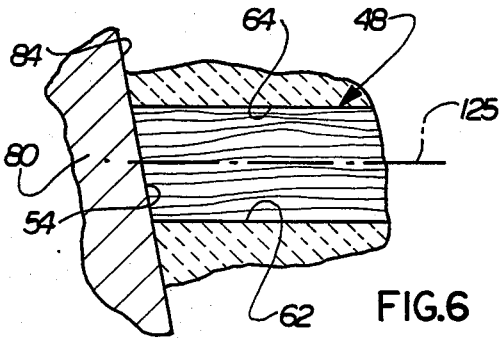
FIG. 6 is a schematic illustration of the manner in which the columnar grains of metal grow radially inwardly from the surface of the chill through the open ended airfoil forming sections of the mold.

During solidification of the molten metal in the airfoil forming sections 48, the molten metal solidifies radially inwardly along fronts which extend generally perpendicular to the longitudinal central axes 125 (FIG. 6) of the airfoil forming sections. However, the leading edge portion 18 (FIG. 2) of each of the airfoils 14 is thicker than the trailing edge portion. Therefore, heat must be extracted at a greater rate from the lower portions 62 of the airfoil forming sections 48 where the leading edges 18 of the airfoils 14 are formed than from the upper portions 64 of the airfoil forming sections where the trailing edges 20 of the airfoils are formed.

To provide for even radially inward solidification from the chill surface 84 along the airfoil forming sections 48, heat is extracted at a greater rate from the thick leading edge forming portions 62 than from the thin trailing edge forming portions 64. The greater rate of heat extraction from the leading edge forming portions 62 is obtained by having them disposed downwardly toward the end wall 78 of the chill 76. The thin trailing edge portions 64 are disposed upwardly toward the relatively hot furnace cavity.

During solidification of the molten metal in the airfoil forming sections 48, heat is extracted at a relatively high rate in a radially outward direction to the exposed annular chill wall 80. In addition, heat flows downwardly toward the end wall 78 of the chill 76. However, the rate at which heat is extracted downwardly, toward the end wall 78 of the chill, is substantially less than the rate at which heat is extracted radially outwardly to the annular chill wall 80. This is because the mold 38 is spaced apart from the end wall 78 and because the metal at the open end 54 of the airfoil forming section 48 is disposed in abutting engagement with the annular chill wall 80. However, heat is extracted at a greater rate from the leading edge forming portion 64 than from the trailing edge forming portion 62.

The rate at which heat is extracted from the leading edge forming portion 64 is modulated by placing a layer of insulation 128 over the circular bottom section 86 of the chill cavity 82. By trial and error, the extent to which the insulation 128 extends outwardly over the chill surface 86 and the thickness of this layer of insulation is determined to provide for solidification of the molten metal in the airfoil forming sections 48 along fronts which extend generally perpendicular to the longitudinal central axes of the airfoil forming sections 48. This results in the growth of the columnar grains of metal in directions parallel to the central axes of the airfoil forming sections 48.

While the metal is solidifying in the airfoil forming sections 48, the metal remains molten in the main section 46 of the mold cavity 42. This enables molten metal to flow from the main section 46 into the airfoil forming sections 48 to compensate for shrinkage of the metal as it solidifies. To maintain the molten metal in the main section 46 molten, the layers 132 of insulation may be provided in the main section 40 of the mold immediately beneath the main section 46 to thereby retard the flow of heat from the main section 46 of the mold to the end wall 78 of the chill. In addition, maintaining the metal molten in the main section 46 of the mold cavity 42 is facilitated by energizing the upper coil section 102 during initial solidification of the metal in the airfoil forming sections 48.

Due to the close proximity of the airfoil forming sections 48 to each other, there may be a tendency for the mold 38 to split along a radially extending plane through the mold cavity 42. This tendency will be particularly pronounced when there are a large number of airfoils 14 on the wheel 10. With this construction, the airfoils are closely adjacent to each other so that there is a relatively small amount of mold material between adjacent airfoil forming sections 48.

Figure 7:
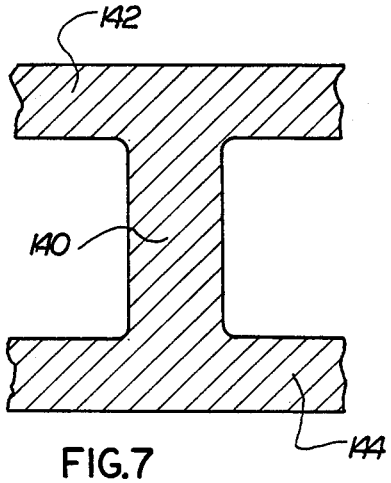
FIG. 7 is an enlarged fragmentary illustration of a reinforcing section of the mold.

To prevent the mold 38 from slitting or separating into upper and lower sections, reinforcing sections 140 (see FIG. 7) may be formed between upper and lower major sides 142 and 144 of the mold 38. The reinforcing sections 140 are formed by providing openings in the hub section of the wax pattern. Therefore, as the wax pattern is covered with ceramic mold material, the ceramic mold material enters these openings to form the reinforcing sections 140. It is contemplated that the reinforcing sections 140 may be advantageously formed at spaced apart locations in the main section 46 of the mold cavity. Of course, the reinforcing sections 140 are positioned at locations where the forming of an opening through the central portion of the wheel 10 will not be objectionable.

SUMMARY

In view of the foregoing it is apparent that the present invention provides a new and improved method of forming a cast one-piece wheel 10 having a plurality of airfoils 14 with a desired crystalline structure. The wheel 10 is cast in a mold 38 having open ended airfoil forming sections 48. Thus, each of the airfoil forming sections 48 has an inner end 52 which opens into a central portion 46 of the mold and an outer end at an opening 54 in an outer side surface area of the mold.

After the mold 38 has been preheated, the mold and chill 76 are brought into engagement. The chill has a surface 84 which blocks the open outer ends 54 of the airfoil forming sections 48. When molten metal is poured into the mold, it flows through the chill at the open outer ends 54 of the airfoil forming sections. Assuming that it is desired to form the airfoils with a columnar grain crystalline structure, the rapid removal of heat from the molten metal 38 by the chill 76 promotes the growth of columnar grains inwardly away from the chill, through the airfoil forming sections 48, to the central portion 46 of the mold.

Heat is transferred from the relatively thick leading edge portions 62 of the airfoil forming sections 48 to the chill 76 at a greater rate that from the relatively thin trailing edge portions 64 of the airfoil forming sections. This promotes solidification of the molten metal in the airfoil forming sections 48 along fronts which extend generally perpendicular to the longitudinal central axes 125 of the airfoils. When a columnar grain crystalline structure is desired, this promotes the growth of columnar crystals having longitudinal axes which extend parallel to the central axes 125 of the airfoils.

Having described specific preferred embodiments of the invention, the following is claimed:

1. A method of casting a one-piece wheel having a circular hub portion with a plurality of generally radially outwardly projecting air foils having a columnar grain crystalline structure with longitudinal axes of the columnar grains extending generally parallel to longitudinal central axes of the airfoils, said method comprising the steps of providing a mold having a mold cavity with a circular main section and a plurality of generally radially outwardly extending air foil forming sections having open outer end portions disposed in a circular array, providing a chill having a circular side wall, said step of providing a chill includes the step of providing an end wall which extends inwardly from the side wall toward a central portion of the chill, preheating the mold while it is spaced from the chill, thereafter, moving the preheated mold and circular side wall of the chill into abutting engagement with the side wall of the chill extending across the open outer end portions of the air foil forming sections, said step of moving the preheated mold and the side wall of the chill into abutting engagement being performed with portions of the air foil forming sections in which leading edge portions of the airfoils are formed being closer to the end wall of the chill than portions of the airfoil forming sections in which trailing edge portions of the airfoil are formed, flowing molten metal through the airfoil forming sections into engagement with side wall of the chill, and solidifying the molten metal by growing a plurality of columnar grains inwardly away from the side wall of the chill through each of the airfoil forming sections toward the mail section of the mold cavity with the longitudinal central axis of the columnar grains extending generally parallel to central axes of the airfoil forming sections in which the columnar grains are formed.

2. A method as set forth in claim 1 further including the step of maintaining the mold spaced from the end wall of the chill when the mold is in abutting engagement with the side wall of the chill.

3. A method as set forth in claim 1 wherein the side wall and end wall of the chill form an open ended chill cavity, said step of preheating the mold being performed with the mold spaced from the chill cavity, said step of moving the preheated mold and side wall of the chill into abutting engagement including effecting relative movement between the preheated mold and chill so that at least a portion of the preheated mold is disposed in the chill cavity.

4. A method as set forth in claim 1 wherein said step of moving the mold and chill into abutting engagement includes the step of raising the chill into engagement with the preheated mold.

5. A method a set forth in claim 1 wherein said step of moving the mold and chill into abutting engagement includes the step of lowering the preheated mold into engagement with the chill.

6. A method as set forth in claim 1 wherein said step of providing a chill includes the step of providing an annular chill having an axially tapered inner side surface which is skewed at an angle of less than twenty degrees to a central axis of the annular chill.

7. A method as set forth in claim 1 wherein said step of moving the mold and chill into abutting engagement includes maintaining the mold and end wall of the chill in a spaced apart relationship.

8. A method as set forth in claim 1 further including the step of conducting a cooling fluid through the circular side wall of the chill.

9. A method as set forth in claim 1 wherein said step of providing a mold includes the steps of providing a pattern having a circular central section with a configuration corresponding to the configuration of the circular main section of the mold cavity, a plurality of airfoil sections extending generally radially outwardly from the main section, and a rim section connected with the air foil sections of the pattern, covering the pattern with ceramic mold material, exposing a mold side surface which was at least partially shaped by an inner side surface of the rim section by separating ceramic mold material shaped by an outer side surface of the rim section from ceramic mold material shaped by the inner side surface of the rim section, the openings in the outer side surface areas of the mold surface being exposed by said step of separating ceramic mold material shaped by the outer side surface of the rim section.

10. A method as set forth in claim 9 wherein said step of moving the preheated mold and circular side wall of the chill into engagement includes the step of effecting abutting engagement between the chill and the mold side surface which was at least partially shaped by the inner side surface of the rim section.

11. A method as set forth in claim 10 wherein the rim section of the pattern is connected directly to radially outer ends of the airfoil sections of the pattern.

12. A method of casting a one-piece wheel having a hub portion and a plurality of airfoils which project outwardly from the hub portion, said method comprising the steps of providing a mold having a mold cavity with a main section and a plurality of open-ended airfoil forming sections extending outwardly from the main section, each of the open-ended airfoil forming sections having an inner end portion which opens into the main section of the mold cavity and an open outer end portion which opens to a circular and axially tapered outer side surface area of the mold, providing a chill having a ring section with a circular inner side surface which tapers axially and radially inwardly from a relatively large diameter outer end portion to a relatively small diameter inner end portion, preheating the mold with the mold spaced apart from the chill, positioning the axially tapered outer side surface of the preheated mold and the axially tapered inner side surface of the ring section of the chill in engagement with the circular inner side surface of the ring section of the chill extending across the open outer end portions of the air foil forming sections, said step of positioning the preheated mold and chill in engagement includes effecting relative movement between the preheated mold and chill from a relationship in which the mold is separated from the space enclosed by an outer side surface of the ring section of the chill to a relationship in which the preheated mold is at least partially enclosed by the ring section of the chill, thereafter, flowing molten metal into the airfoil forming sections, engaging the ring section of the chill with the molten metal adjacent the open outer end portions of the airfoil forming sections, initiating solidification of the molten metal in the airfoil forming sections from the ring section of the chill, and continuing the solidification of the molten metal in a direction away from the ring section of the chill through the airfoil forming sections.

13. A method as set forth in claim 12 wherein said step of providing a chill includes the step of providing an annular chill ring section in which the axially tapered inner side surface which is skewed at an angle of less than twenty degrees to a central axis of the annular chill.

14. A method as set forth in claim 12 wherein said step of providing a chill includes the step of providing a chill having a base section which is connected with and extends across the inner end portion of the ring section, said step of positioning the mold and chill in engagement includes the step of positioning the mold and chill relative to each other with the base section of the chill spaced from the mold.

15. A method as set forth in claim 14 further including the step of providing insulating material in at least a portion of the space between the mold and the base section of the chill.

16. A method as set forth in claim 12 wherein said step of positioning the mold and chill in engagement includes the step of raising the chill into engagement with the preheated mold.

17. A method a set forth in claim 12 wherein said step of positioning the mold and chill in engagement includes the step of lowering the preheated mold into engagement with the chill.

18. A method as set forth in claim 1 wherein said steps of initiating solidification and continuing solidification of the molten metal away from the chill through the airfoil forming sections includes initiating the formation of a plurality of grains of metal at spaced apart locations on the inner side surface of the chill ring section where the molten metal engages the chill and growing columnar grains of the metal through the airfoil forming sections to the circular main section of the mold cavity.

19. A method as set forth in claim 12 wherein said step of providing a mold having open-ended airfoil forming sections includes the step of providing airfoil forming sections with open end portions which define openings in the circular outer side surface area of the mold, each of the airfoil forming sections having transverse cross sectional configurations corresponding to the cross sectional configuration of an airfoil through out the extent of the airfoil forming sections.

20. A method as set forth in claim 12 wherein said step of providing a mold includes the steps of providing a pattern having a circular central section with an configuration corresponding to the configuration of t e main section of the mold cavity, a plurality of airfoil sections extending generally radially outwardly from the central section, and a rim section connected with the airfoil sections of the pattern, covering the pattern with ceramic mold material, exposing a mold side surface which was at least partially shaped by an inner side surface of the rim section by separating ceramic mold material shaped by an outer side surface of the rim section from ceramic mold material shaped by the inner side surface of the rim section, the opening in the outer side surface areas of the mold surface being exposed by said step of separating ceramic mold material shaped by the outer side surface of the rim section.

21. A method as set forth in claim 20 wherein said step of positioning the mold and chill in engagement includes the step of effecting abutting engagement between the chill and the mold side surface which was at least partially shaped by the inner side surface of the rim section of the pattern.

22. A method as set forth in claim 21 wherein the rim section of the pattern is connected directly to radially outer ends of the airfoil sections of the pattern.

23. A method of casting a one-piece wheel having a hub portion and a plurality of airfoils which project outwardly from the hub portion and having relatively thick leading edge portions and relatively thin trailing edge portions, said method comprising the steps of providing a mold having a mold cavity with a main section and a plurality of open-ended airfoil forming sections extending outwardly from the main section, each of the open-ended air foil forming sections having an inner end portion which opens into the main section of the mold cavity and an open outer end portion which opens to an outer side surface area of the mold, each of the airfoil forming portions having a leading edge forming portion in which a relatively thick leading edge of an airfoil is formed and a trailing edge forming portion in which a relatively thin trailing edge of an airfoil is formed, Providing a chill having a base section and a ring section which is connected with the base section, positioning the outer side surface of the mold and an inner side surface of the ring section of the chill in engagement with the inner side surface f the ring section of the chill extending across the open outer end portions of the airfoil forming sections, said step of positioning the mold and chill in engagement includes positioning the leading edge forming portions of the airfoil forming sections of the mold and the base section of the chill closed to each other than the trailing edge forming portions of the airfoil forming sections of the mold and the base section of the chill, flowing molten metal into the airfoil forming sections engaging the ring section of the chill with the molten metal adjacent the open outer end portions of the airfoil forming sections, initiating solidification of the molten metal in the airfoil forming sections from the ring section of the chill, and continuing the solidification of the molten metal in a direction away from the ring section of the chill through the airfoil forming sections, said step of continuing the solidification of the molten metal including solidifying the molten metal in each airfoil forming section of the mold along a front which extend generally perpendicular to a longitudinal axis of the airfoil forming section by transferring heat at a first rate from the leading edge forming portion to the base section of the chill and transferring heat at a second rate from the trailing edge forming portion to the base section of the chill, the first rate of heat transfer being greater than the second rate of heat transfer.

24. A method as set forth in claim 23 wherein said step of positioning the mold and chill in engagement includes the step of positioning the mold and chill relative to each other with the base section of the chill spaced from the mold.

25. A method a set forth in claim 24 further including the step of providing insulating material in at least a portion of the space between the mold and the base section of the chill.

26. A method as set forth in claim 23 further including the step of providing a body of insulating material between at least a portion of the main section of the mold cavity and the base section of the chill while leaving the heat transfer path from at least a major portion of the airfoil forming sections to the base section of the chill free o the body of insulating material which is disposed between the main section of the mold cavity and the base section of the chill.

27. A method as set forth in claim 23 further including the step of reheating the mold while the mold is spaced apart from the chill, said step of positioning the mold and chill in engagement being performed after performance of said step of preheating the mold.

28. A method as set forth in claim 23 further including the step of conducting cooling fluid through the base and ring sections of the chill.

29. A method of casting a one-piece wheel having a hub portion and a plurality of airfoils which project outwardly from the hub portion, said method comprising the steps of providing a mold having a mold cavity with a main section and a plurality of open-ended airfoil forming sections extending outwardly form the main section, each or the open-ended airfoil forming sections having an inner edge portion which opens into the main section of the mold cavity and an open outer end portion which opens to an outer side surface area of the mold, providing a chill having a base section and a ring section which is connected with the base section, positioning the outer side surface of the mold and an inner side surface of the ring section of the chill in engagement with the inner side surface of the ring section of the chill extending across the open outer end portions of the airfoil forming sections, providing a body of insulating material between the main section of the mold cavity and the base section of the chill to retard the transfer of heat from the main section of the mold cavity to the base section of the chill, said step of providing a body of insulating material between the main section of the mold cavity and the base section of the chill including the steps of providing a body of insulating material having a smaller thermal conductivity than the material of the mold and leaving the heat transfer path from at least a major portion of each of the airfoil forming sections of the mold to the base section of the chill free of the body of insulating material to facilitate the transfer of heat from airfoil forming sections of the mold to the base section of the chill, thereafter, flowing molten metal into the airfoil forming sections while conducting a flow of cooling fluid through the ring section of the chill, engaging spaced apart locations on the ring section of the chill with the molten metal adjacent the open outer end portions of the airfoil forming section while maintaining the flow of cooling fluid through the ring section of the chill, initiating solidification of the molten metal in the airfoil forming sections from the spaced apart locations on the ring section of the chill, and continuing the solidification of the molten metal in a direction away from the ring section of the chill through the airfoil forming sections while maintaining the flow of cooling fluid through the ring section of the chill, said step of continuing the solidification of the molten metal including solidifying the molten metal in each airfoil forming section of the mold by transferring heat from the airfoil forming sections of the mold to the base section of the chill along a heat transfer path which ±s disposed outwardly of the body of insulating material.

30. A method as set forth in claim 29 further including the step of conducting a flow of cooling fluid through the base section of chill while transferring heat from the airfoil forming sections of the mold to the base section of the chill.

31. A method as set forth in claim 29 wherein said step of providing a body of insulating material between the main section of the mold cavity and the base section of the chill includes the step of enclosing the body of insulating material with mold material.

32. A method as set forth in claim 29 wherein said step of positioning the mold and chill in engagement includes positioning the mold and chill relative to each other with the base section of the chill spaced from the mold.

33. A method as set forth in claim 32 wherein said step of providing a body of insulating material between the main section of the mold cavity and the chill includes the step of placing insulating material on an upper side surface of the base section of the chill between the main section of the mold cavity and the base section of the chill.

34. A method as set forth in claim 66 further including the steps of preheating the mold with the mold spaced apart from the chill, said step of positioning the mold and chill in engagement includes the step of effecting relative movement between the preheated mold and the chill form a relationship in which a lower side surface the mold is separated from the space enclosed by an outer side surface of the ring section of the chill to a relationship in which the lower side surface of the preheated mold is enclosed by the ring section of the chill and is spaced from the base section of the chill.

35. A method as set forth in claim 32 further including the step of providing a layer of insulating material over an outer side surface of the ring section of the chill to impede the transfer of heat to the chill through the outer side surface of the chill during said steps of initiating and continuing solidification of the molten meal in the airfoil forming sections.

36. A method as set forth in claim 32 wherein said step of providing a body of insulating material between the main section of the mold cavity and the chill includes the step of enclosing the body of insulating material with mold material.

37. A method of casting a one-piece wheel having a hub portion and a plurality of airfoils which project outwardly from the hub portion, said method comprising the steps of providing a mold having a mold cavity with a main section and a plurality of open-ended airfoil forming sections extending upwardly from the main section, said step of providing a mold includes the step of providing a mold having airfoil forming sections with leading edge forming portions in which relatively thick leading edges of airfoils are formed and trailing edge forming portions in which relatively than trailing edges of air foils are formed, each of the open-ended airfoil forming sections having an inner end portion which opens into the main section of the mold cavity and an open outer end portion which opens to a circular and axially tapered outer side surface area of the mold, providing a chill having a ring section with a circular inner side surface which tapers axially and radially inwardly from a relatively large diameter outer end portion to a relatively small diameter inner end portion and a base section which is connected with and extends across the inner end portion of the ring section, preheating the mold with the mold spaced apart from the chill, positioning the axially tapered outer surface of the preheated mold and the axially tapered inner side surface of the ring section of the chill in engagement with the circular inner side surface of the ring section of the chill extending across the open outer end portions of the airfoil forming section, said step of positioning the preheated mold and chill in engagement includes effecting relative movement between the preheated mold and chill from a relationship in which the mold is separated from the space enclosed by an outer side surface of the ring section of the chill to a relationship in which the preheated mold is at least partially enclosed by the ring section of the chill, said step of positioning the preheated mold and chill in engagement includes positioning the leading edge forming portions of the airfoil forming section of the mold and the base section of the chill closer to each other than the trailing edge forming portions of the air foil forming sections of the mold and the base section of the chill, thereafter, flowing molten metal into the airfoil forming sections, engaging the ring section of the chill with the molten metal adjacent the open outer end portions of the airfoil forming sections, initiating solidification of the molten metal in the airfoil forming sections from the ring section of the chill, and continuing the solidification of the molten metal in a direction away from the ring section of the chill through the airfoil forming sections, said step of continuing the solidification of the metal includes solidifying the molten metal in each airfoil forming section of the mold along a front which extends generally perpendicular to a longitudinal axis of the airfoil forming section by transferring heat at a first rate from the leading edge forming portion to the base section of the chill and transferring that at a second rate from the trailing edge forming portion to the base section of the chill, said first rate of heat transfer being greater than said second rate of heat transfer.

38. A method a set forth in claim 37 wherein said step of providing a chill includes the step of providing an annular chill ring section in which the axially tapered inner side surface which is skewed at an angle of less than twenty degrees to a central axis of the annular chill.

39. A method as set forth in claim 37 wherein said step of positioning the mold and chill in engagement includes the step of positioning the mold and chill relative to each other with the base section of the chill spaced from the mold.

40. A method as set forth in claim 39 further including the step of providing insulating material in at least a portion of the space between the mold and the base section of the chill.

41. A method as set forth in claim 37 wherein said step of positioning the mold and chill in engagement includes the step of raising the chill into engagement with the preheated mold.

42. A method a set forth in claim 37 wherein said step of positioning the mold and chill in engagement includes the step of lowering the preheated mold into engagement with the chill.

43. A method as set forth in claim 37 further including the step of conducting cooling fluid through the base section and ring section of the chill.

44. A method as set forth in claim 37 wherein said steps of initiating solidification and continuing solidification of the molten metal away from the chill through the airfoil forming sections includes initiating the formation of a plurality of grains of metal at spaced apart locations on the inner side surface of the chill ring section where the molten metal engages the chill and growing columnar grains of the metal through the airfoil forming sections to the circular main section of the mold cavity.

45. A method as set forth in claim 37 wherein said step of providing a mold having open-ended airfoil forming sections includes the step of providing airfoil forming sections with open end portions which define openings in the circular outer side surface area of the mold, each of the airfoil forming sections having transverse cross sectional configurations corresponding to the cross sectional configuration of an airfoil through out the extent of the air foil forming sections.

46. A method as set forth in claim 72 where said set of providing a mold includes the steps of providing a pattern having a circular central section with a configuration corresponding to the configuration of the main section of the mold cavity, a plurality of airfoil sections extending generally radially outwardly from the central section, and a rim section connected with the airfoil sections of the pattern, covering the pattern with ceramic mold material, exposing a mold side surface which was at least partially shaped by an inner side surface of the rim section by separating ceramic mold material shaped by an outer side surface of the rim section from ceramic mold material shaped by the inner side surface of the rim section, the openings in the outer side surface areas of the mold surface being exposed by said step of separating ceramic mold material shaped by the outer side surface of the rim section.

47. A method as set forth in claim 81 wherein aid step of positioning the mold and chill in engagement includes the step of effecting abutting engagement between the chill and the mold side surface which was at least partially shaped by the inner side surface of the rim section of the pattern.

48. A method as set forth in claim 82 wherein the rim section of the pattern is connected directly to radially outer ends of the airfoil sections of the pattern.

49. A method of casting a one-piece wheel having a hub portion and a plurality of airfoils which project outwardly from the hub portion, said method comprising the steps of providing a mold having a mold cavity with a main section and a plurality of open-ended airfoil forming sections extending outwardly from the main section, said step of providing a mold includes providing airfoil forming sections having first surface areas for forming a leading edge portion of an airfoil and second surface areas for forming a trailing edge portion of an airfoil, each of the open-ended airfoil forming sections having an inner end portion which opens into the main section of the mold cavity and an open outer end portion which opens to a circular and axially tapered outer side surface area of the mold, providing a chill having a ring section with a circular inner side surface which tapers axially and radially inwardly from a relatively large diameter outer end portion to a relatively small diameter inner end portion and a base section which is connected with an extends across the inner end portion of the ring section, preheating the mold with the mold spaced apart from the chill, positioning the axially tapered outer side surface of the preheated mold and the axially tapered inner side surface of the ring section of the chill in engagement with the circular inner side surface of the ring section of the chill extending across the open outer end portions of the airfoil forming sections, said step of positioning the preheated mold and chill in engagement includes effecting relative movement between the preheated mold and chill from a relationship in which the mold is separated from the space enclosed by an outer side surface of the ring section of the chill to a relationship in which the preheated mold is at least partially enclosed by the ring section of the chill, thereafter, flowing molten metal into the airfoil forming sections, engaging the ring section of the chill with the molten metal adjacent the open outer end portions of the airfoil forming sections, initiating solidification of the molten metal in the airfoil forming sections from the ring section of the chill, and continuing the solidification of the molten metal in a direction away from the ring section of the chill through the airfoil forming sections, said step of positioning the mold and chill in engagement includes positioning the first surface areas of the airfoil forming sections and the base section of the chill closer to each other than the second surface areas of the airfoil forming sections and the base section of the chill to promote a greater rate of transfer of heat to the chill from the portions of the airfoil forming sections which form the leading edge portions of the airfoils than from the portions of the airfoil forming sections which form the trailing edge portions of the airfoils.

50. A method as set forth in claim 84 further including the step of conducting cooling fluid through the base section and ring section of the chill.

51. A method as set forth in claim 49 wherein said steps of initiating solidification and continuing solidification of the molten metal away from the chill through the airfoil forming sections includes initiating the formation of a plurality of grains of metal at spaced apart locations on the inner side surface of the chill ring section where the molten metal engages the chill and growing columnar grains of the metal through the airfoil forming sections to the circular main section of the mold cavity.

52. A method as set forth in claim 49 wherein said step of providing a mold having open-ended airfoil forming sections includes the step of providing airfoil forming sections with open end portions which define openings in the circular outer side surface area of the mold, each of the airfoil forming sections having transverse cross sectional configurations corresponding to the cross sectional configuration of an airfoil throughout the extent of the airfoil forming sections.

53. A method as set forth in claim 49 wherein said step of providing a mold includes the steps of providing a pattern having a circular central section with a configuration corresponding to the configuration of the main section of the mold cavity, a plurality of airfoil sections extending generally radially outwardly from the central section, and a rim section connected with the airfoil sections of the pattern, covering the pattern with ceramic mold material, exposing a mold side surface which was at least partially shaped by an inner side surface of the rim section by separating ceramic mold material shaped by an outer side surface of the rim section from ceramic mold material shaped by the inner side surface of the rim section, the openings in the outer side surface areas of the mold surface being exposed by said step of separating ceramic mold material shaped by the outer side surface of the rim section.

54. A method of casting a one-piece wheel having a hub portion and a plurality of airfoils which project outwardly from the hub portion, said method comprising the steps of providing a mold having a mold cavity with a main section and a plurality of open-ended airfoil forming sections extending outwardly from the main section, said step of providing a mold includes providing airfoil forming sections having first surface areas for forming a leading edge portion of an airfoil and second surface areas for forming a trailing edge portion of an airfoil, each of the open-ended airfoil forming sections having an inner edge portion which opens into the main section of the mold cavity and an open outer end portion which opens to an outer side surface area of the mold, providing a chill having a base section and a ring section which is connected with the base section, positioning the outer side surface of the mold and an inner side surface of the ring section of the chill in engagement with the inner side surface of the ring section of the chill extending across the open outer end portions of the airfoil forming sections, said step of positioning the mold and chill in engagement includes positioning the mold and chill relative to each other with the base section of the chill spaced from the mold, and with the first surface areas of the airfoil forming sections and the base section of the chill closer to each other than the second surface areas of the airfoil forming sections and the base section of the chill to promote a greater rate of transfer of heat to the chill from the portions of the airfoil forming sections which form the leading edge portions of the airfoils than from the portions of the airfoil forming sections which form the trailing edge portions of the airfoils, providing a body of insulating material between the main section of the mold cavity and the base section of the chill to retard the transfer of heat from the main section of the mold cavity to the base section of the chill, said step of providing a body of insulating material between the main section of the mold cavity and the base section of the chill including the steps of providing a body of insulating material having a smaller thermal conductivity than the material of the mold and leaving the heat transfer path from at least a major portion of each of the airfoil forming sections of the mold to the base section of the chill free of the body of insulating material to facilitate the transfer of heat from airfoil forming sections of the mold to the base section of the chill, thereafter, flowing molten metal into the airfoil forming sections while conducting a flow of cooling fluid through the ring section of the chill, engaging spaced apart locations on the ring section of the chill with the molten metal adjacent the open outer end portions of the airfoil forming sections while maintaining the flow of cooling fluid through the ring section of the chill, initiating solidification of the molten metal in the airfoil forming sections from the spaced apart locations on the ring section of the chill, and continuing the solidification of the molten metal in a direction away from the ring section of the chill through the airfoil forming sections while maintaining the flow of cooling fluid through the ring section of the chill, said step of continuing the solidification of the molten metal including solidifying the molten metal in each airfoil forming section of the mold by transferring heat from the airfoil forming sections of the mold to the base section of the chill along a heat transfer path which is disposed outwardly of the body of insulating material.

55. A method as set forth in claim 54 further including the step of conducting a flow of cooling fluid through the base section of chill while transferring heat from the airfoil forming sections of the mold to the base section of the chill.

56. A method as set forth in claim 54 wherein said step of providing a body of insulating material between the main section of the mold cavity and the base section of the chill includes the step of enclosing the body of insulating material with mold material.

57. A method as set forth in claim 54 wherein said step of providing a body of insulating material between the main section of the mold cavity and the chill includes the step of placing insulating material on an upper side surface of the base section of the chill between the main section of the mold cavity and the base section of the chill.

58. A method as set forth in claim 54 further including the steps of preheating the mold with the mold spaced apart from the chill, said step of positioning the mold and chill in engagement includes the step of effecting relative movement between the preheated mold and the chill from a relationship in which a lower side surface the mold is separated from the space enclosed by an outer side surface of the ring section of the chill to a relationship in which the lower side surface of the preheated mold is enclosed bay the ring section of the chill and is spaced from the base section of the chill.

59. A method as set forth in claim 54 further including the step of providing a layer of insulating material over an outer side surface of the ring section of the chill to impede the transfer of heat to the chill through the outer side surface of the chill during said steps of initiating and continuing solidification of the molten metal in the airfoil forming sections.

60. A method as set forth in claim 54 wherein said step of providing a body of insulating material between the main section of the mold cavity and the chill includes the step of enclosing the body of insulating material with mold material.

61. A method of casting a one-piece wheel having a hub portion and a plurality of airfoils which project outwardly from the hub portion and have a columnar grain crystalline structure with longitudinal axes extending generally parallel to longitudinal central axes of the airfoils, said method comprising the steps of providing a mold having a mold cavity with a main section and a plurality of open-ended airfoil forming sections extending outwardly from the main section, each of the open-ended airfoil forming sections having an inner end portion which opens into the main section of the mold cavity and an open outer end portion which opens to a circular and axially extending outer side surface area of the mold, providing a chill having a ring section with an axially extending circular inner side surface, said step of providing a chill includes the step of providing a chill having a base section which is connected with the ring section, preheating the mold with the mold spaced apart from the chill, positioning the circular outer side surface of the preheated mold and the circular inner side surface of the ring section of the chill in engagement with the circular inner side surface of the ring section of the chill circumscribing the mold and extending across the open outer end portions of the airfoil forming sections, said step of positioning the old and chill in engagement includes the step of positioning the mold and chill relative to each other with the base section of the chill spaced from the mold, thereafter, flowing molten metal into the airfoil forming sections, engaging the axially extending circular inner side surface of the ring section of the chill with the molten metal adjacent the open outer end portions of the airfoil forming sections, initiating solidification of the molten metal as a plurality of grains of metal at spaced apart locations on the circular inner side surface of the chill ring section where the molten metal engages the chill, and growing columnar grains of metal radially inwardly in a direction away from the circular inner side surface of the chill ring section through the airfoil forming sections to the main section of the mold cavity with the central axes of the columnar grains generally parallel to the longitudinal central axes of the airfoils.

62. A method as set forth in claim 61 further including the step of providing insulating material in at least a portion of the space between the mold and the base section of the chill.

63. A method as set forth in claim 61 further including the step of conducting cooling fluid through the base section and ring section of the chill.

64. A method of casting a one-piece wheel having a hub portion and a plurality of airfoils which project outwardly from the hub portion and having a columnar grain crystalline structure with longitudinal axes extending generally parallel to longitudinal central axes of the airfoils, said method comprising the steps of providing a mold having a mold cavity with a main section and a plurality of open-ended airfoil forming sections extending outwardly form the main section, each of the open-ended airfoil forming sections having an inner end portion which opens into the main section of the mold cavity and an open outer end portion which opens to a circular and axially extending outer side surface area of the mold, providing a chill having a ring section with an axially extending circular inner side surface, said step of providing a chill includes the step of providing an annular chill ring section having an axially tapered inner side surface which is skewed at an angle of less than twenty degrees to a central axis of the annular chill, preheating the mold with the mold spaced apart from the chill, positioning the circular outer side surface of the preheated mold and the circular inner side surface of the ring section of the chill in engagement with the circular inner side surface of the ring section of the chill circumscribing the mold and extending across the open outer end portions of the airfoil forming sections, thereafter, flowing molten metal into the airfoil forming sections, engaging the axially extending circular inner side surface of the ring section of the chill with the molten metal adjacent the open outer end portions of the airfoil forming sections, initiating solidification of the molten metal as a plurality of grains of metal at spaced apart locations on the circular inner side surface of the chill ring section where the molten metal engages the chill, and growing columnar grains of metal radially inwardly in a direction away from the circular inner side surface of the chill ring section through the airfoil forming sections to the main section of the mold cavity with the central axes of the columnar grains generally parallel to the longitudinal central axes of the airfoils.

* * * * *

UNITED STATES PATENT AND TRADEMARK OFFICE

CERTIFICATE OF CORRECTION

PATENT NO. : 4,850,419

DATED : July 25, 1989

INVENTOR(S) : William S. Blazek

It is certified that error appears in the above-identified patent and that said Letters Patent is hereby corrected as shown below:

Column 9, Line 32, change "air foils" to --airfoils--.

Column 9, Line 38, change "air foil" to --airfoil--.

Column 9, Line 51, change "air foil" to --airfoil--.

Column 9, Line 61, change "mail" to --main--.

Column 10, Line 37, change "air foil" to --airfoil--.

Column 11, Line 8, change "air foil" to --airfoil--.

Column 11, Line 51, change "l" to --12--.

Column 12, Line 3, change "an" to --a--.

Column 12, Line 4, change "t e" to --the--.

Column 12, Line 14, Change "opening" to --openings--.

Column 12, Line 35, change "air foil" to --airfoil--.

Column 12, Line 47, change "f" to --of--.

Column 12, Line 53, change "closed" to --closer--.

Column 12, Line 56, insert --,-- between "sections" and "engaging".

Column 12, Line 66, change "extend" to --extends--.

Column 13, Line 21, change "o" to --of--.

Column 13, Line 25, change "reheating" to --preheating--.

Column 13, Line 38, change "or" to --of--.

Column 13, Line 67, change "section" to --sections--.

Column 14, Line 12, change "±s" to --is--.

Column 14, Line 36, change "66" to --32--.

Column 14, Line 41, change "form" to --from--.

Column 14, Line 52, change "meal" to --metal--.

UNITED STATES PATENT AND TRADEMARK OFFICE

CERTIFICATE OF CORRECTION

PATENT NO. : 4,850,419

DATED : July 25, 1989

INVENTOR(S) : William S. Blazek

It is certified that error appears in the above-identified patent and that said Letters Patent is hereby corrected as shown below:

Column 14, Line 64, change "upwardly" to --outwardly--.

Column 15, Line 14, insert --side-- between "outer" and "surface".

Column 15, Line 29, change first occurence of "section" to --sections--.

Column 15, Line 31, change "air foil" to --airfoil--.

Column 15, Line 47, change "that" to --heat--.

Column 15, Line 41, insert --molten-- between "the" and "metal".

Column 16, Line 29, change "72" to --37--.

Column 16, Line 29, change "where" to --wherein--.

Column 16, Line 29, change "set" to --step--.

Column 16, Line 46, change "81" to --46--.

Column 16, Line 46, change "aid" to --said--.

Column 16, Line 52, change "82" to --47--.

Column 17, Line 6, change "an" to --and--.

Column 17, Line 40, change "84" to --49--.

Column 20, Line 4, change "old" to --mold--.

Signed and Sealed this

Twenty-sixth Day of June, 1990

*Attest:*

HARRY F. MANBECK, JR.

*Attesting Officer*

*Commissioner of Patents and Trademarks*